United States Patent [19]

Zildjian

[11] 4,114,502

[45] Sep. 19, 1978

[54] CYMBAL

[75] Inventor: Armand A. Zildjian, Hingham, Mass.

[73] Assignee: Avedis Zildjian Company, Norwell, Mass.

[21] Appl. No.: 804,921

[22] Filed: Jun. 9, 1977

[51] Int. Cl.[2] ..... G10D 13/06
[52] U.S. Cl. ..... 84/402
[58] Field of Search ..... 84/402, 418, 411, 421, 84/422

[56] References Cited

U.S. PATENT DOCUMENTS 3,453,923 7/1969 Paiste ..... 84/402

*Primary Examiner*—L. T. Hix
*Assistant Examiner*—S. D. Schreyer
*Attorney, Agent, or Firm*—Edgar H. Kent

[57] ABSTRACT

A cymbal has a first mounting aperture generally centered on the cymbal and second mounting aperture laterally offset from the first mounting aperture, and has different characteristic tones when mounted to a support stand by the first and second apertures respectively.

3 Claims, 4 Drawing Figures

CYMBAL

BACKGROUND OF THE INVENTION

1. Field of the Invention

This invention relates to cymbals, particularly cymbals which are centrally suspended from a support device for playing.

2. Description of the Prior Art

Cymbals are made in various categories according to variations in size, weight and surface curvature, the latter variation including various tapers, and surface curvatures varying from a substantially uniform or "flat topped" curvature to those which have a central cup or "bell," which is of shorter radius than the remainder or "bow" of the cymbal and rises above it. Cymbals are also made especially for different uses, such as those played singly, and paired cymbals which are struck together, hand held or by foot pedal stand.

The invention is applicable to cymbals of all categories but more particularly to cymbals played individually and which are provided with a central aperture to receive a pin on a supporting stand to suspend the cymbal for playing. The support stands are usually provided with an adjustable top by which the suspension of the cymbal may be varied from horizontal to various angles thereto to suit the convenience of the player.

The tone of high quality cymbals contains a blend of virtually all the notes of the scale or their harmonic complements, made up of a fundamental tone or "bell tone," and overtones. Cymbals of the different categories mentioned vary from one another quite distinctly in tone. But, even cymbals of a given category and seeming identity each has its characteristic distinct tone, according to its unique dominant pitch and response to sympathetic vibration. Therefore, a cymbal player for orchestra or dance band usually has available to him a number of cymbals of different characteristic tone which, from his knowledge thereof, he can select to match the requirements of the score being played, or to produce a desired tonal blend.

SUMMARY OF THE INVENTION

An object of this invention is to provide a cymbal which has two distinct characteristic tones which differ from one another substantially and which may be imparted to the cymbal selectively by the manner in which it is mounted when played..

Another object is to provide such a cymbal in which each characteristic tone is of the same high quality.

It has been discovered that the objects of the invention are attained by providing the cymbal with a second mounting aperture offset from the cnventional central mounting aperture, and by selectively mounting the cymbal to the support by the central aperture or by the offset aperture to provide the two distinct characteristic tones when the cymbal is struck. The offset aperture is preferably of the same size and shape as the central aperture, normally a round, ½ inch (13 mm) diameter hole. The offset aperture is desirably centered not more than approximately 2 inches (51 mm) from the center of the central aperture, preferably 1.25 inches (32 mm) or somewhat less.

Although the presence of the offset aperture changes somewhat the characteristic tone of the cymbal when played mounted by its central aperture, as compared to such tone without the second aperture, surprisingly the tone, while modified, is not degraded. Furthermore, while the characteristic tone of the cymbal when mounted by the offset aperture is distinctly different from that of the cymbal mounted by the central aperture, it is of the same quality. It is therefore possible according to the invention to provide cymbals with two distinct characteristic tones without degrading tonal quality of the cymbal, apparently due to variation in amount of overtones and volume. The offset aperture is produced after the cymbal has been surface-grooved, and may be drilled and reamed in the same manner customary with the central aperture.

It will be evident that the invention adds negligibly to the cost of a cymbal, yet greatly enlarges its utility, enabling a cymbal to function alternatively to provide different tones, as would require two cymbals of the prior art. The user is thus enabled to provide an equal tonal variety of cymbals at half the cost or greater variety at lesser cost, and with a single cymbal for the first time has tonal variety available to him. The offset aperture does provide some tilt to the cymbal from horizontal when mounted on a vertically disposed mounting pin, but such tilting is not great, particularly where the aperture spacing is as preferred, and is scarcely a disadvantage since most players incline the cymbals for playing by means of adjustable top stands. Thus, by varying the adjustment, the player can provide the same incline of the cymbal using either mounting aperture, or he can use the offset aperture to provide tilting on a non-adjustable stand for one characteristic tone of the cymbal.

DESCRIPTION OF THE PREFERRED EMBODIMENTS

Figure 1:
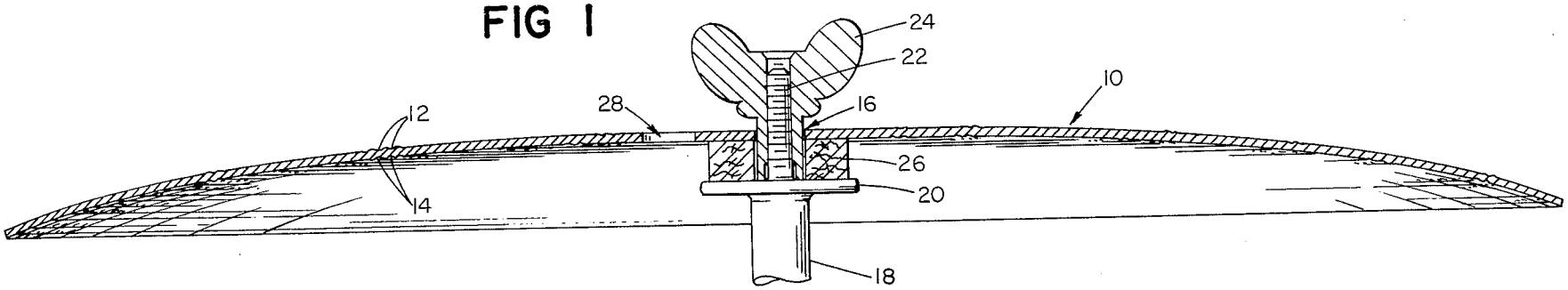
FIG. 1 is a view partially in transverse cross-section, partially in elevation, of a cymbal according to the invention and of the top of a stand on which it is mounted.
Figure 2:
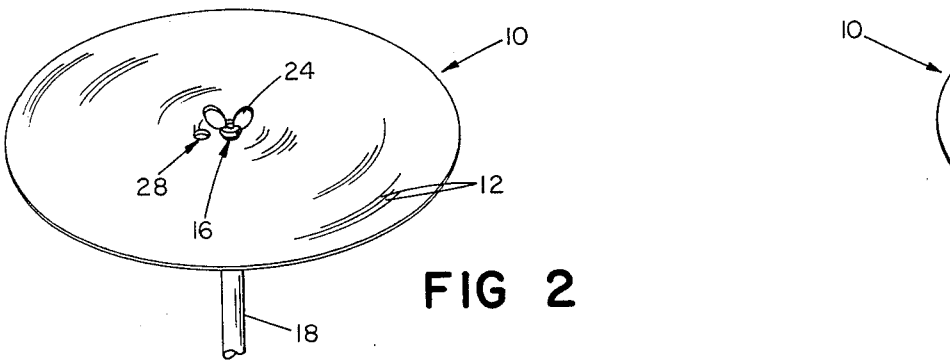
FIG. 2 is a perspective view of the cymbal and mounting stand top shown in FIG. 1.
Figure 3:
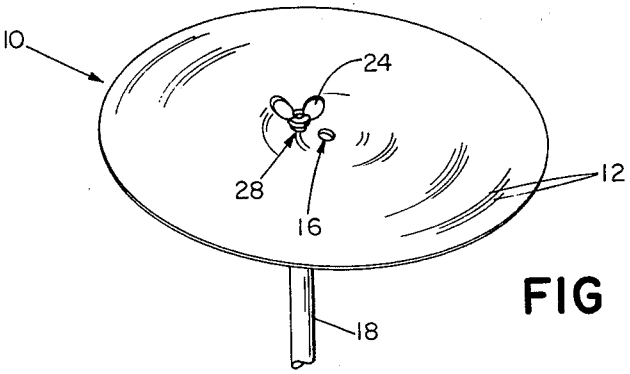
FIG. 3 is a view similar to FIG. 2 showing the cymbal differently mounted on the stand.

The cymbal 10 shown in FIGS. 1–3 is of annular disc form, being a conventional flat-topped type and size (e.g. 7 to 24 inches (178–610 mm) in diameter) which is concavo-convex and is provided with the usual tonal grooves 12 and 14 on its convex and concave surfaces. It has a conventional central circular mounting aperture 16 by which it is mounted to the top 18 of a supporting stand, the remainder of which is not shown in the Figures and may be of either the fixed or adjustable top types. Top 18 has the usual flange 20 with a central upstanding externally threaded boss 22 which is projected through aperture 16 and receives an internally threaded cap wing nut 24 to retain the cymbal on stand top 18 through an intermediate felt washer 26 on flange 20.

In accordance with the invention, a second mounting aperture 28 is provided in cymbal 10 with its center spaced laterally from the center of the cymbal and of aperture 16. Aperture 28 preferably has the same shape and diameter (about ½ inch (13 mm)) as aperture 16, with its center spaced from the center of aperture 16 about 1.25 inches (32 mm ) or at least within 2 inches (51 mm) therefrom.

FIG. 2 shows the cymbal of FIG. 1 mounted to stand top 18 by its central aperture 16 so that it is disposed substantially at a right angle to the axis of top 18 and is horizontal with top 18 vertically disposed as shown. FIG. 3 shows the cymbal of FIG. 1 mounted to stand top 18 by its mounting aperture 28 so that it is inclined somewhat to the axis of top 18, due in part to the curvature of the cymbal and in part to the off-centering of aperture 28 relative to the cymbal and the greater weight-compression of washer 26 on the side of boss 22 away from aperture 28.

It will be noted that by tilting the top 18 of an adjustable top stand, the cymbal mounted as in FIG. 2 can be inclined at the same angle to vertical as the cymbal mounted as in FIG. 3 with the stand top vertical. Also, by tilting top 18 in FIG. 3 in the direction from its center toward the center of aperture 28, the cymbal can be brought from the inclined position shown to a horizontal position, or by tilting in the opposite direction its incline to the horizontal may be increased.

The cymbal 10 mounted by its aperture 16 as in FIG. 2 has a characteristic tone distinctly different from its characteristic tone when mounted by aperture 28 as in FIG. 3, whether, in either case, the cymbal is inclined or horizontal. Assuming the usual high quality standards are observed in the manufacture of the cymbal, there is no loss in, or difference of quality between, the two tones, although both will differ from the characteristic tone of a like cymbal not provided with aperture 28.

Figure 4:
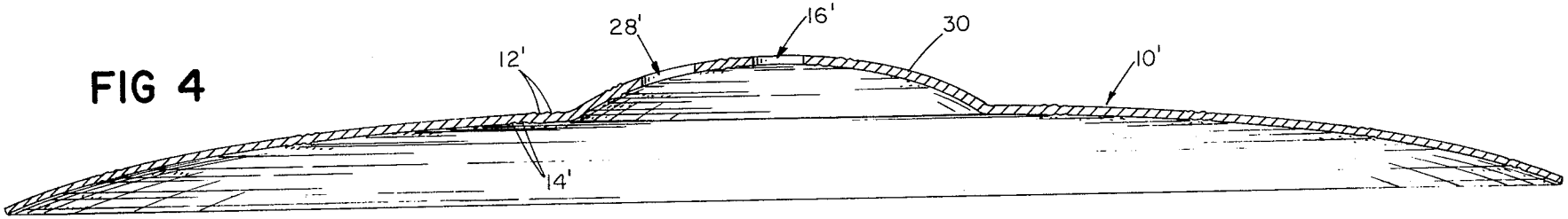
FIG. 4 is a transverse cross-section view of another cymbal embodying the invention.

FIG. 4 shows the invention applied to a different cymbal 10′ which differs from cymbal 10 in having a central portion or bell 30 which is curved on a smaller radius than the remainder of the cymbal. The difference in curvature of portion 30 causes the cymbal to incline more to the axis of top 18 when mounted thereto by aperture 28′ but otherwise the cymbal 10′ corresponds in all respects to cymbal 10.

While it is preferable that aperture 16 or 16′ be centered on the cymbal as it normally is, it may be offset slightly but so that it remains generally centered on the cymbal.

I claim:

1. A cymbal of annular disc form provided with surface tonal grooves and adapted to be centrally suspended from a support device for playing, having a first mounting aperture generally centered on the cymbal and a second mounting aperture laterally offset from said first mounting aperture, the center of said second aperture being spaced within two inches from the center of said first aperture, said cymbal having different characteristic tones when mounted to a support stand by said respective apertures.

2. A cymbal according to claim 1 wherein the center of said second aperture is spaced about 1.25 inches from the center of said first aperture.

3. A cymbal according to claim 1 wherein said apertures are circular and have a diameter of about 0.5 inch.

* * * * *